US006583681B1

(12) United States Patent
Makino et al.

(10) Patent No.: US 6,583,681 B1
(45) Date of Patent: Jun. 24, 2003

(54) NONRECIPROCAL CIRCUIT DEVICE WITH VERTICAL CAPACITORS ABOVE HALF THICKNESS OF THE FERRITE

(75) Inventors: Toshihiro Makino, Matto (JP); Takashi Kawanami, Ishikawa-ken (JP); Takahiro Jodo, Ishikawa-ken (JP); Takashi Hasegawa, Kanazawa (JP); Masakatsu Mori, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/501,563

(22) Filed: Feb. 9, 2000

(30) Foreign Application Priority Data

Feb. 15, 1999 (JP) ..... 11-036268
Dec. 21, 1999 (JP) ..... 11-363323

(51) Int. Cl.[7] ..... H01P 1/36; H01P 1/383
(52) U.S. Cl. ..... 333/1.1; 333/24.2
(58) Field of Search ..... 333/1.1, 24.2

(56) References Cited

FOREIGN PATENT DOCUMENTS

| | | | |
|---|---|---|---|
| EP | 0 653 799 | 5/1995 | ..... H01P/1/32 |
| EP | 0903801 | 3/1999 | |
| JP | 57-67308 | * 4/1982 | ..... 333/1.1 |
| JP | 10303605 | 11/1998 | |

OTHER PUBLICATIONS

Great Britain Search Report dated Sep. 15, 2000, For Application # GB 0002967.8.

* cited by examiner

*Primary Examiner*—Justin P. Bettendorf
(74) *Attorney, Agent, or Firm*—Keating & Bennett, LLP

(57) ABSTRACT

A nonreciprocal circuit device which can be miniaturized, and can achieve low insertion loss, having plate-like capacitors disposed vertically. Single plate capacitors are arranged vertically so that their electrode faces are at an angle of 90 degrees to a ferrite, and in addition, their bottom faces are at a position above the bottom half of the thickness of the ferrite, or more preferably, at a position higher than the top face of the ferrite.

23 Claims, 4 Drawing Sheets

NONRECIPROCAL CIRCUIT DEVICE WITH VERTICAL CAPACITORS ABOVE HALF THICKNESS OF THE FERRITE

BACKGROUND OF THE INVENTION

1. Field of the Invention

The present invention relates to a nonreciprocal circuit device, such as an isolator or a circulator, used at a high-frequency band, such as a microwave band, and also relates to a communications device using the nonreciprocal circuit device.

2. Description of the Related Art

Recently, given the growing demand for miniaturized and inexpensive mobile communications apparatuses such as mobile telephones, there are similar demands for a miniaturized and inexpensive nonreciprocal circuit device. To meet this demand, the present assignee disclosed an isolator comprising a vertical capacitor, wherein single plate capacitors are used as capacitors for matching, and are provided vertical to the mounting surface of the isolator (Japanese Patent Application No. 9-252207, i.e. Unexamined Patent Publication No. 1999-97910).

This isolator comprises a permanent magnet provided on the inner face of a top yoke, a bottom yoke attached to the top yoke to form a magnetically closed circuit, a resin case provided on the lower face in the bottom yoke, a magnetic structure comprising three central conductors provided on a ferrite in the resin case, three capacitors for matching, and a termination resistor. Then, single plate capacitors comprising electrodes provided on both main faces of a dielectric substrate are used as the capacitors for matching in order to reduce costs, and each single plate capacitor C is provided vertical to the ferrite 55 to make the size of the isolator smaller, as shown in FIG. 6. FIG. 6 is a diagram showing the positional relationship, between a ferrite and a single plate capacitor. In the isolator mentioned above, the single plate capacitor C is provided at a position such that the bottom edge of the capacitor C is disposed less than half of the thickness of the ferrite 55 above the bottom face of the ferrite.

When the isolator is miniaturized, that is, when its constituent members are required to be miniaturized, a problem that the insertion loss increases is caused, and consequently it is demanded strongly to achieve both miniaturization and reduction of insertion loss.

When the above isolator is viewed from the side, the electrode face of the capacitor overlaps with the side face of the ferrite, whereby the electrodes of the capacitor obstruct the high-frequency magnetic field created by the central conductors, shortening the path of the magnetic field, and abruptly altering the high-frequency magnetic field around the central conductors. As a consequence, the magnetic components of the central conductors perpendicular to the DC magnetic field required for magnetic coupling are reduced, and insertion loss increases. That is, although the isolator described above can be more miniaturized by providing the capacitors vertically, it has a disadvantage that insertion loss cannot be reduced.

Furthermore, in the constitution described above, when the hot end electrode of the capacitor is provided to face the ferrite side, the ground terminal of the central conductors and the hot end electrode of the capacitor are liable to be short-circuited. Consequently, the distance between the capacitor and the central conductors is required to be increased, or an insulator is required to be disposed between the capacitor and the central conductors. As a result, this makes it more difficult to achieve miniaturization and low costs.

SUMMARY OF THE INVENTION

Accordingly, it is an object of the present invention to provide a nonreciprocal circuit device which can be inexpensively miniaturized by vertically providing a plate-like capacitor, and a communications device using the same.

In order to achieve the above objects, according to a first aspect of the present invention a nonreciprocal circuit device comprises a plurality of central conductors provided on a plate-like ferrite, to which a permanent magnet applies a DC magnetic field, and plurality of plate-like capacitors are connected to respective ports of the central conductors. The ferrite is provided so that both main faces thereof are parallel to the mounting surface, and the capacitors are provided such that electrode surfaces of the capacitors are substantially perpendicular to the mounting surface and respective bottom faces of the capacitors are disposed more than half of the thickness of the ferrite above the bottom face of the ferrite.

Preferably, the capacitors are disposed higher than the top face of the ferrite.

In another aspect of the present invention, the capacitors are single plate capacitors, comprising electrodes provided on both main faces of a dielectric substrate.

Alternatively, the capacitors are multilayer capacitors, comprising a plurality of dielectrics and a plurality of electrodes which are laminated alternately.

Furthermore, a communications device according to the present invention comprises the above nonreciprocal circuit device.

The present inventors have discovered that, in a nonreciprocal circuit device wherein the electrode faces of capacitors are disposed substantially perpendicular to the main face of a ferrite on which a plurality of central conductors are provided, the insertion loss of the nonreciprocal circuit device can be improved by changing the positional relationship between the ferrite and the capacitors.

That is, as will be explained clearly in the following preferred embodiment, the nonreciprocal circuit device can be miniaturized by providing plate-like capacitors substantially perpendicular to the ferrite. In addition, when the bottom faces of the capacitors are disposed above the bottom half of the thickness of the ferrite, it is possible to improve a level of insertion loss in practical use.

Furthermore, the insertion loss can be minimized by disposing the bottom face of the capacitors higher than the top main face of the ferrite.

Moreover, when a capacitor having electrodes on both main faces thereof, such as a single plate capacitor, is disposed at a position higher than the top main face of the ferrite, since the capacitor is not located on the side face of the ferrite, short-circuiting between the ground side of the central conductors and the hot end electrode of the capacitor can be prevented.

Furthermore other, a single plate capacitor or a multilayer capacitor can be used for the capacitors. A single plate capacitor is easily manufactured, enabling costs to be reduced. Furthermore, by using multilayer capacitors, the device can be further miniaturized.

Furthermore, the communications device according to the present invention comprises a single plate capacitor having characteristics described above, and therefore, it has excellent characteristics, being miniaturized and inexpensive.

Other features and advantages of the invention will be appreciated from the following description of embodiments thereof.

DESCRIPTION OF THE PREFERRED EMBODIMENTS

Figure 1:
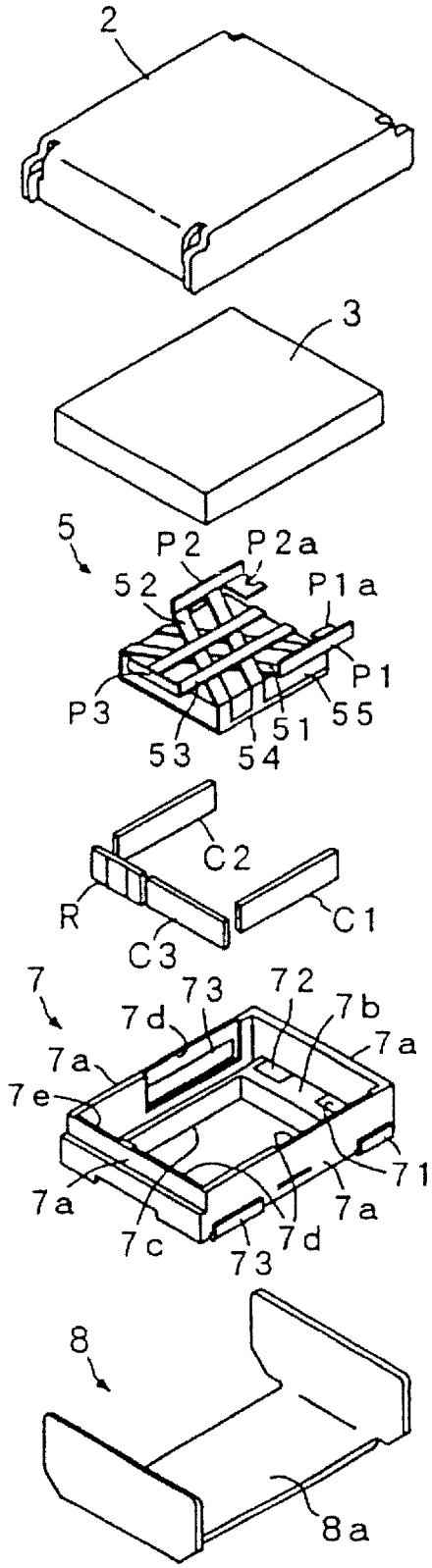
FIG. 1 is an exploded perspective view of an isolator according to a first embodiment.
Figure 2:
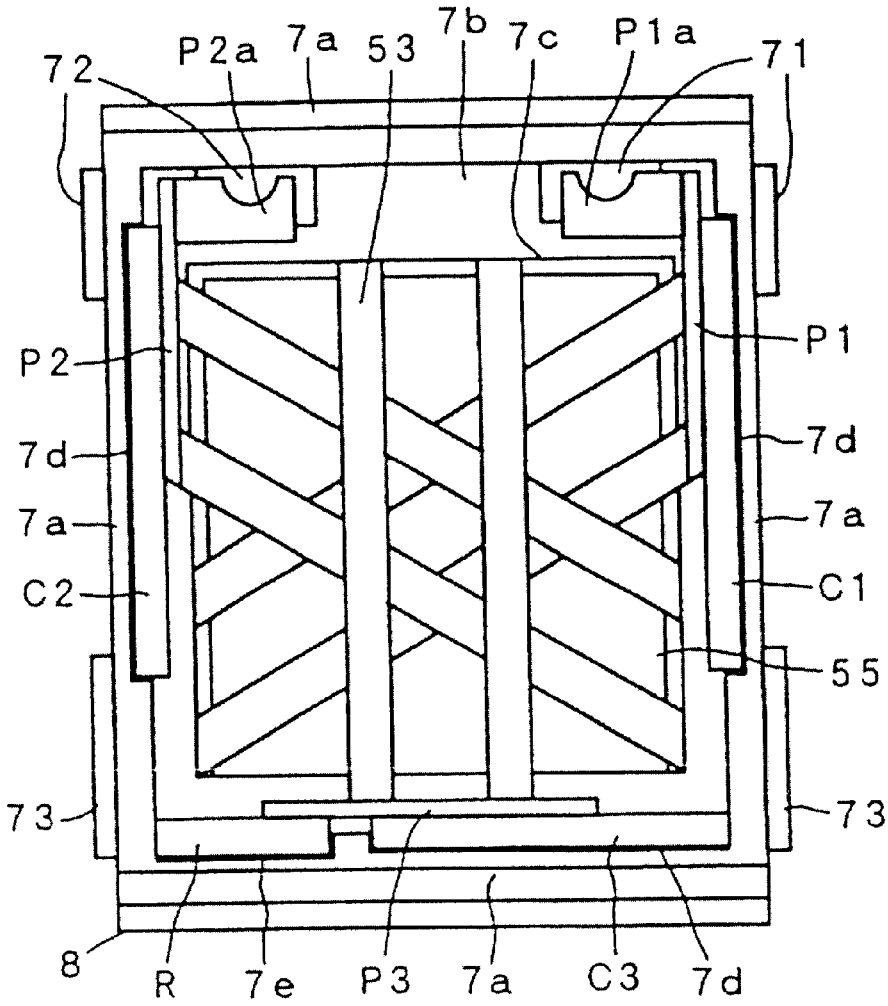
FIG. 2 is a plan view of the isolator according to the first embodiment.
Figure 3:
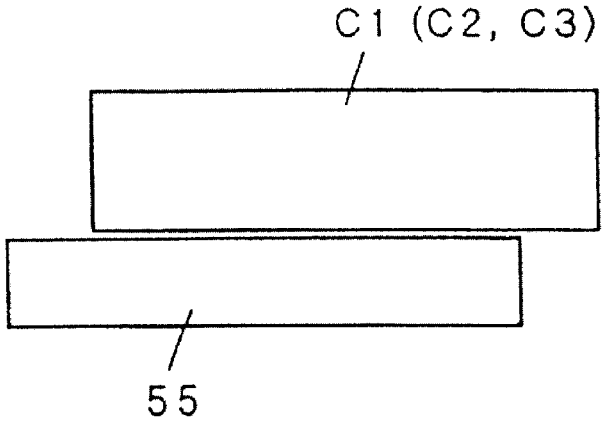
FIG. 3 is a diagram showing the positional relationship between a single plate capacitor and a ferrite of the isolator according to the first embodiment.

A constitution of an isolator according to a first preferred embodiment of the present invention will be explained with reference to FIGS. 1 to 3. FIG. 1 is an exploded perspective view of the isolator, FIG. 2 is a plan view of the state when the permanent magnet and top yoke are removed, and FIG. 3 is a diagram showing the positional relationship between a single plate capacitor and the ferrite. FIG. 3 does not show the central conductors.

The isolator of the present invention comprises a permanent magnet 3 provided on the inner face of a box-like top yoke 2 comprising a magnetic metal a substantially C-shaped bottom yoke 8 comprising the same magnetic metal as the top yoke 2 and forming a magnetic closed circuit therewith; a resin case 7 provided on the bottom wall 8*a* of the bottom yoke 8; a magnetic structure 5, single plate capacitors C1 to C3, and a termination resistor R being provided inside the resin case 7. The magnetic structure 5 is adapted to receive a DC magnetic field from the permanent magnet 3.

The isolator is parallelepiped shape in appearance, having plan dimensions of 5.0 mm×5.0 mm, and a thickness (height) of 2.0 mm, and is surface-mounted on a mounting substrate constituting a transceiver circuit of a mobile communications device, such as a mobile telephone.

The abovementioned magnetic structure 5 is formed by providing three central electrodes 51 to 53, comprising thin plate-like metal plates and intersecting at angles of 120 degrees, on the top face of a plate-shaped ferrite 55, with an insulating sheet (not shown in the figure) provided between the central electrodes and on top of the ferrite ports P1 to P3 defined respectively by any one end of each of the central electrodes 51 to 53 protruding outwardly, and a ground terminal 54 connected commonly to the other ends of the central electrodes 51 to 53 abutting upon the bottom face of the ferrite 55.

The upper and lower main faces of the ferrite 55 and the central electrodes 51 to 53 are disposed parallel to the mounting surface, and the ports P1 to P3 of the central electrodes 51 to 53 are bent upwardly so as to be perpendicular to the mounting surface. Tips P1*a* and P2*a* of the two ports P1 and P2 are parallel to the mounting surface.

The above resin case 7 comprises rectangular frame-like side walls 7*a* formed integrally with a bottom wall 7*b*, the input/output terminals 71 and 72 and ground terminals 73 being partially embedded in the resin, and a square-shaped insertion hole 7*c*, provided approximately in the center of the bottom wall 7*b*. Recessed portions 7*d* for containing the single plate capacitors C1 and C2 are provided in the inner faces of the left and right side walls 7*a*, and a recessed portion 7*d* for containing the single plate capacitor C3 and a recessed portion 7*e* for containing the termination resistor R are provided in the inner face of the lower side wall 7*a*. The recessed portions 7*d* and 7*e* are formed to make openings by removing cutting the top portions of the side walls 7*a*, to allow the single plate capacitors C1 to C3 and the termination resistor R to be inserted easily.

The input/output terminals 71 and 72 are provided so that one end thereof is exposed at the top face of the bottom wall 7*b*, and the other end is exposed at the lower face of the bottom wall 7*b* and the outer face of the side wall 7*a*. Furthermore, the ground terminals 73 are provided so that one end thereof is respectively exposed at the inner face of the recessed portions 7*d* in which the single plate capacitors C1 to C3 are provided, and at the inner face of the recessed portion 7*e* in which the termination resistor R is provided. The other end of each ground terminal is provided so as to be exposed at the bottom face of the bottom wall 7*b* and the outer face of the side wall 7*a*.

The single plate capacitors C1 to C3 function as capacitors for matching, comprising capacitor electrodes provided entirely over both main faces of a plate-like dielectric substrate so as to face each other on either side of the substrate, and are manufactured by providing electrodes on both sides of a large mother substrate, and cutting the mother substrate in a lattice shape.

The single plate capacitors for matching C1 to C3 are provided in the recessed portions 7*d* in the side walls 7*a* of the resin case 7, the termination chip resistor R is provided in the recessed portion 7*e* in the lower side wall 7*a*, the magnetic structure 5 is inserted into the insertion hole 7*c*, and the ground 54 of each central electrode 51 to 53 on the bottom face of the magnetic structure 5 is connected to the top of the bottom wall 8*a* of the bottom yoke 8.

The single plate capacitors C1 to C3 are provided so that their electrode faces are perpendicular to the mounting surface to define an angle of 90 degrees, and their bottom faces are disposed higher than the top face of the ferrite 55 (see FIG. 3). The bottom faces of the single plate capacitors C1 to C3 abut on the bottom of the recessed portions 7*d* mentioned above, thereby positioning the capacitors in the vertical direction. Furthermore, the ports P1 to P3 of the central electrodes 51 to 53 are bent upwardly, so that the single plate capacitors C1 to C3 can be securely connected at a position higher than the top face of the ferrite 55.

The cold end side electrodes of the single plate capacitors C1 to C3 are connected to the ground terminals 73 exposed at the inner faces of the recessed portions 7*d*, and the hot end side electrodes are connected to the ports P1 to P3 of the central electrodes 51 to 53.

Furthermore, the tips P1*a* and P2*a* of the ports P1 and P2 are connected respectively to the input/output terminals 71 and 72 exposed on the bottom wall 7*b*, the port P3 is connected to one side electrode of the termination resistor R, and the other side electrode of the termination resistor R is connected to the ground terminal 73, exposed at the inner face of the recessed portion 7*e*. The termination resistor R is also provided vertically at an angle of 90 degrees to the mounting surface. The above members are soldered together by reflow soldering.

As described above, the constitution of the isolator of the present embodiment enables the single plate capacitors C1 to C3 to be easily and reliably provided vertical to the mounting surface and the main face of the ferrite 55, and at a position such that their bottom faces are disposed higher than the top face of the ferrite 55. The shape of the recessed portions 7*d* provided in the side walls is not restricted to that described in the above embodiment. Furthermore, the single plate capacitors C1 to C3 can be provided at a desired position in the vertical direction by changing the position of the bottom faces of the recessed portions 7*d* in the vertical (height) direction. Furthermore, it is not essential for the angle between the single plate capacitors C1 to C3 and the mounting surface to be vertical (90 degrees), and it needs only be provided at an angle to the mounting surface which is within a range of ±30 degrees from 90 degrees, thereby enabling the mount area corresponding to the gradient to be reduced, further aiding miniaturization.

Figure 4:
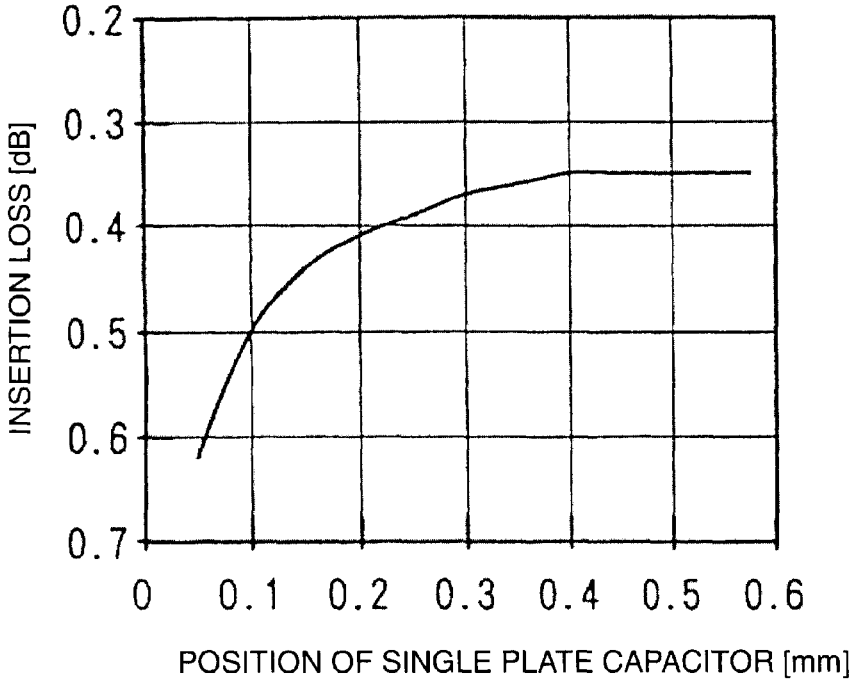
FIG. 4 is a diagram showing the relationship between the position of the single plate capacitor of the isolator according to the present invention and insertion loss.

Next, the operation and effects of the present invention will be explained based on test results. FIG. 4 shows changes in the insertion loss of an isolator having the constitution described above when the position of the bottom faces of the single plate capacitors is changed around a base point (0 mm) at a position on the bottom face of the ferrite. Data at an intermediate frequency of approximately 920 MHz was obtained using a ferrite 55: 3.0×3.0×0.5 mm, single plate capacitors C1 and C2: 0.9×2.0×0.2 mm having a capacitance 9 pF, and a single plate capacitor C3: 0.9×3.1×0.2 mm having a capacitance of 14 pF.

As can be understood from FIG. 4, the insertion loss decreases as the positions of the capacitors are raised, and reaches its minimum when the capacitors are at approximately the same position as the top face of the ferrite (0.5 mm in FIG. 4). Furthermore, when the capacitors are positioned at half the thickness of the ferrite (0.25 mm in FIG. 4), the insertion loss is 0.4 dB or less.

An isolator having the dimensions of the present embodiment can be used practically when the insertion loss is 0.4 dB or less. To achieve this, the capacitors should preferably be provided at a position higher than half of the thickness of the ferrite.

Furthermore, when the capacitors are provided higher than the top face of the ferrite, the insertion loss can be minimized, obtaining even better characteristics. Moreover, when the capacitors are provided higher than the top face of the ferrite, the single plate capacitors do not need to be positioned at the side faces of the ferrite, and consequently there is no short-circuiting between the ground side of the central conductors and the hot end side of the single plate capacitors, enabling reliability to be improved.

In the embodiment described above, single plate capacitors are used as the capacitors for matching, but the present invention is not limited to this, and multilayer capacitors comprising a plurality of dielectrics and a plurality of capacitor electrodes being laminated alternately, and having at least one capacitor electrode being provided inside a dielectric substrate, may alternatively be used as the capacitors when multilayer capacitors are used, the capacitor electrode faces for obtaining capacitance are provided substantially vertical to the mounting surface, and the bottom faces of the multilayer capacitors are positioned higher than half of the thickness of the ferrite, or higher than the top face of the ferrite. As a consequence, the same effects as those of the single plate capacitors can be achieved.

Furthermore, although the above embodiment describes an example of an isolator, the present invention can also be applied to a circulator in which the port P3 is not connected to the termination resistor R, but rather is connected to a third input/output terminal.

Furthermore, the entire constitution is not restricted to that of the embodiment described above. A characteristic feature of the present invention is that plate-like capacitors provided in a nonreciprocal circuit device are substantially vertical to the mounting surface, with restrictions on the position of the capacitors, and there are no restrictions on other parts of the constitution.

Figure 5:
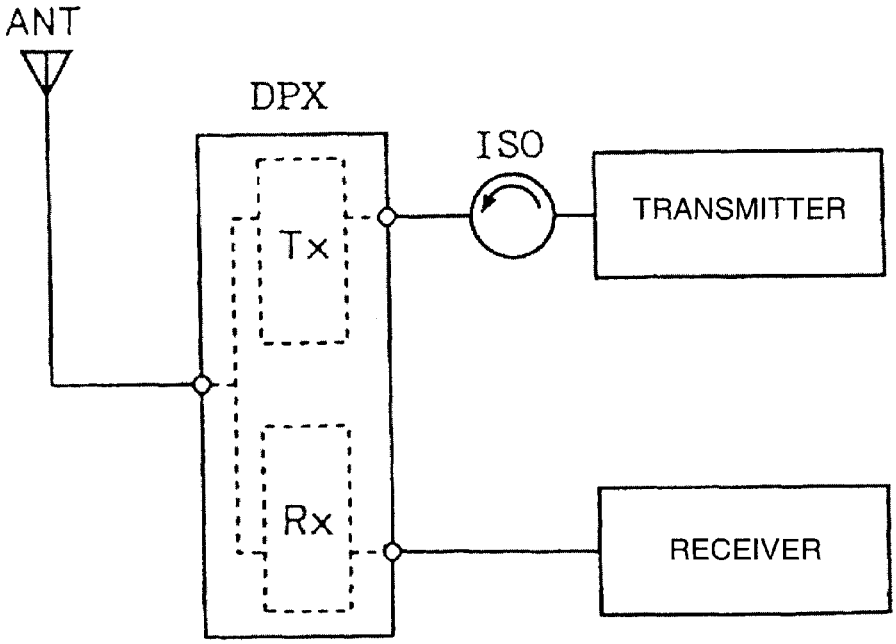
FIG. 5 is a block diagram of a communications device according to a second embodiment.
Figure 6:
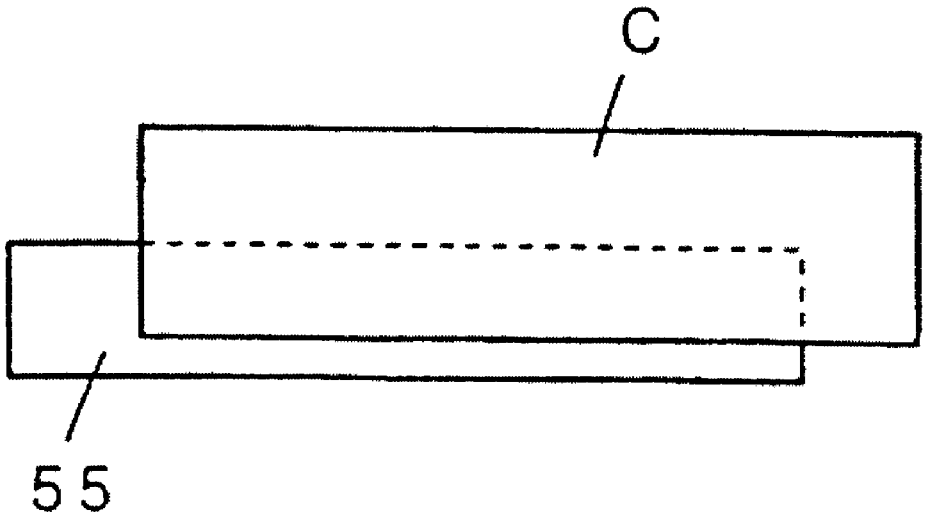
FIG. 6 PRIOR ART
FIG. 6 is a diagram showing the positional relationship between a single plate capacitor and a ferrite of a conventional isolator.

Next, FIG. 5 shows a communications device according to a second embodiment of the present invention. This communications device comprises an antenna ANT connected to an antenna terminal of a duplexer DPX, comprising a filter for transmitting TX and a filter for receiving RX, an isolator ISO connected between the input terminal of the filter for transmitting TX and a transmitter, and a receiver connected to the output terminal of the filter for receiving RX. Signals transmitted from the transmitter pass via the isolator ISO and the filter for transmitting TX, and are emitted from the antenna ANT. Furthermore, signals received by the antenna ANT pass through the filter for receiving RX, and are input to the receiver.

Here, the isolator described in the embodiment above can be applied to the communications device as the isolator ISO. By using the nonreciprocal circuit device of the present invention, it is possible to obtain a miniaturized and inexpensive communications device having excellent characteristics.

As described above, according to the nonreciprocal circuit device of the present invention, plate-like capacitors are provided substantially vertical to a ferrite, and in addition, the bottom end faces of the capacitors are positioned higher than a position of half of the thickness of the ferrite, and therefore, the nonreciprocal circuit device can be miniaturized, and its insertion loss can be reduced.

Furthermore, when the bottom faces of the capacitors are at a position higher than the top main face of the ferrite, the insertion loss can be minimized.

Moreover, since short-circuiting between the ground side of the central conductors and the electrode of the capacitor can be prevented, reliability is improved.

Furthermore, by using single plate capacitors as the capacitors, costs can be reduced. Furthermore, by using multilayer capacitors, further miniaturization can be achieved.

Furthermore, by mounting the nonreciprocal circuit device according to the present invention,sa miniaturized and inexpensive communications device having excellent characteristics can be obtained.

Although embodiments of the invention have been disclosed, the fair spirit and scope of the invention is not limited thereto, but rather extends to all modifications, equivalents, variations and alternatives that would occur to those having ordinary skill in the pertinent art.

What is claimed is:

1. A nonreciprocal circuit device comprising:

a case;

a plurality of central conductors provided on a plate-shape ferrite in the case, a permanent magnet applying a DC magnetic field to said central conductors and said ferrite, and a plurality of plate-shaped capacitors accommodated in the case and connected to ports of said central conductors;

said ferrite having top and bottom main faces, both main faces thereof being substantially parallel to a mounting surface, and said capacitors being disposed so that electrode surfaces of the capacitors are substantially perpendicular to the mounting surface, and a respective bottom face of each of the capacitors is disposed at a position above the bottom half of the thickness of said ferrite;

each of said plurality of central conductors including a port which is bent upwardly so as to be substantially perpendicular to the mounting surface.

2. The nonreciprocal circuit device according to claim 1, said capacitors being disposed at a position higher than said top face of said ferrite.

3. The nonreciprocal circuit device according to claim 2, each of said capacitors comprising a single plate capacitor having electrodes provided on respective opposed main faces of a dielectric substrate.

4. The nonreciprocal circuit device according to claim 2, each of said capacitors comprising a multilayer capacitor having a plurality of dielectrics and a plurality of electrodes which are laminated alternately.

5. The nonreciprocal circuit device according to claim 1, wherein said plate-shaped capacitors are accommodated in respective recessed portions of said case, and said position of the respective bottom face of each of the capacitors is defined by a bottom face of the corresponding recessed portion.

6. The nonreciprocal circuit device according to claim 1, each of said capacitors comprising a single plate capacitor having electrodes provided on respective opposed main faces of a dielectric substrate.

7. The nonreciprocal circuit device according to claim 1, each of said capacitors comprising a multilayer capacitor having a plurality of dielectrics and a plurality of electrodes which are laminated alternately.

8. The nonreciprocal circuit device according to claim 1, wherein at least a portion of each of said central conductor ports is substantially perpendicular to said mounting surface.

9. The nonreciprocal circuit device according to claim 1, wherein said case includes at least one recessed portion in a side wall thereof such that at least one of said plurality of plate-shaped capacitors is accommodated in said at least one recessed portion.

10. A communication device comprising:

a high-frequency circuit comprising one of a transmitter and a receiver, and a non-reciprocal circuit device connected to said high-frequency circuit;

said non-reciprocal circuit device comprising:

a case;

a plurality of central conductors provided on a plate-shaped ferrite in the case, a permanent magnet applying a DC magnetic field to said central conductors and said ferrite, and a plurality of plate-shaped capacitors accommodated in the case and connected to ports of said central conductors;

said ferrite having top and bottom main faces, both main faces thereof being substantially parallel to a mounting surface, and said capacitors being disposed so that electrode surfaces of the capacitors are substantially perpendicular to the mounting surface, and a respective bottom face of each of the capacitors is disposed at a position above the bottom half of the thickness of said ferrite;

each of said plurality of central conductors including a port which is bent upwardly so as to be substantially perpendicular to the mounting surface.

11. The nonreciprocal circuit device according to claim 10, wherein said plate-shaped capacitors are accommodated in respective recessed portions of said case, and said position of the respective bottom face of each of the capacitors is defined by a bottom face of the corresponding recessed portion.

12. The communication device according to claim 10, each of said capacitors comprising a single plate capacitor having electrodes provided on respective opposed main faces of a dielectric substrate.

13. The communication device according to claim 10, each of said capacitors comprising a multilayer capacitor having a plurality of dielectrics and a plurality of electrodes which are laminated alternately.

14. The communication device according to claim 10, wherein said high-frequency circuit is a transmitter and said non-reciprocal circuit device is connected for carrying signals from said transmitter.

15. The communication device according to claim 10, said capacitors being disposed at a position higher than said top face of said ferrite.

16. The communication device according to claim 15, each of said capacitors comprising a single plate capacitor having electrodes provided on respective opposed main faces of a dielectric substrate.

17. The communication device according to claim 15, each of said capacitors comprising a multilayer capacitor having a plurality of dielectrics and a plurality of electrodes which are laminated alternately.

18. The nonreciprocal circuit device according to claim 10 wherein at least a portion of each of said central conductor ports is substantially perpendicular to said mounting surface.

19. A nonreciprocal circuit device comprising:

a resin case;

a plurality of central conductors provided on a plate-shaped ferrite in the resin case, a permanent magnet applying a DC magnetic field to central conductors and said ferrite, a plurality of plate-shaped capacitors accommodated in respective recessed portions of the resin case and connected to ports of said central conductors; and a plurality of ground terminals, one end of each said ground terminal being disposed in a respective one of said recessed portions adjacent to the corresponding said capacitor;

said ferrite having top and bottom main faces, both main faces thereof being substantially parallel to a mounting surface, and said capacitors being disposed so that electrode surfaces of the capacitors are substantially perpendicular to the mounting surface, and a respective bottom face of each of the capacitors is disposed at a position above the bottom half of the thickness of said ferrite.

20. The nonreciprocal circuit device according to claim 19, wherein said position of the respective bottom face of each of the capacitors is defined by a bottom face of the corresponding recessed portion.

21. The nonreciprocal circuit device according to claim 20, wherein at least a portion of each of said central conductor ports is substantially perpendicular to said mounting surface.

22. The nonreciprocal circuit device according to claim 19, wherein at least a portion of each of said central conductor ports is substantially perpendicular to said mounting surface.

23. The nonreciprocal circuit device according to claim 19, wherein another end of each of said ground terminal extends through the resin case from said recessed portion to the exterior of said resin case.

* * * * *